US010974214B2

(12) United States Patent
Scarborough

(10) Patent No.: US 10,974,214 B2
(45) Date of Patent: Apr. 13, 2021

(54) DUST CONTROL DEVICE AND METHOD OF CONTROLLING AIRBORNE PARTICLES FROM A DUST-CONTAINING MATERIAL

(71) Applicant: SUCKABUCKET.COM LLC, Kent, WA (US)

(72) Inventor: Robert Elee Scarborough, Kent, WA (US)

(73) Assignee: SUCKABUCKET.COM LLC, Kent, WA (US)

( * ) Notice: Subject to any disclaimer, the term of this patent is extended or adjusted under 35 U.S.C. 154(b) by 169 days.

(21) Appl. No.: 15/871,310

(22) Filed: Jan. 15, 2018

(65) Prior Publication Data

US 2019/0217263 A1 Jul. 18, 2019

(51) Int. Cl.
*B01F 15/00* (2006.01)
*B01F 3/12* (2006.01)

(52) U.S. Cl.
CPC ..... *B01F 15/00961* (2013.01); *B01F 3/12* (2013.01)

(58) Field of Classification Search
CPC combination set(s) only.
See application file for complete search history.

(56) References Cited

U.S. PATENT DOCUMENTS 6,024,141 A * 2/2000 Wegman ..... B65B 1/12 141/129
6,145,162 A * 11/2000 Deutschenbaur ..... B23B 49/026 144/252.1
2007/0210081 A1* 9/2007 Bongiornio ..... B44D 3/08 220/4.03
2009/0016152 A1* 1/2009 Beaton ..... B01F 15/00954 366/139

OTHER PUBLICATIONS

The WaleTale. Product Website [online]. Beaton Innovations, LLC, Dec. 31, 2015 [retrieved on Feb. 20, 2020]. Retrieved from the Internet: <https://www.waletale.net>.

* cited by examiner

*Primary Examiner* — Vivek K Shirsat
*Assistant Examiner* — Ko-Wei Lin
(74) *Attorney, Agent, or Firm* — Polsinelli P.C.

(57) ABSTRACT

This invention (FIG. 1) was conceived out of necessity to control hazardous conditions created while mixing materials like concrete or mortar in containers (1) such as a three gallon or five gallon bucket. The invention (2) is a vacuum attachment which produces a low pressure zone within the bucket when a vacuum is applied to the outlet port (3) of the invention that will keep dust and other airborne material from leaving the interior of the invention through the top of the opening (4). It consists of a funnel shaped opening (4) on the top and a channel around the underside of the funnel leading to the vacuum attachment opening (3), which creates high and low pressure zones, which controls the release of particulate into the atmosphere.

13 Claims, 3 Drawing Sheets

DUST CONTROL DEVICE AND METHOD OF CONTROLLING AIRBORNE PARTICLES FROM A DUST-CONTAINING MATERIAL

FIELD OF THE INVENTION

The dust control device was conceived to provide a way to protect workers and others in the area where work is being performed, from the suspended particles in the atmosphere, while mixing products together. This dust control device will help many different workers in the world by providing a product that will give them an additional protection from the ill effects of airborne hazards.

BACKGROUND OF THE INVENTION

Workers often need to mix products in buckets or containers. The resulting process can put the person at risk of airborne particles. The inventor was pondering this idea, and started thinking about different ways to control the dust. Workers were trying to set a vacuum hose near the edge of the bucket but this did not effectively control the dust. The inventor drew up his idea and experimented with a prototype and proved his theory that by creating a venturi while isolating the vacuum attachment point, the worker was able to effectively control the airborne dust.

SUMMARY AND OBJECT OF THE INVENTION

Referring to FIG. 1, the dust control device 10 is fitted to set on top of a container C to be used for mixing, and a vacuum hose V is attached at an attachment point 14 of the dust control device. Once the vacuum V is properly fitted and turned on, the worker adds the mixtures to the container through the top of the dust control device 10, and then proceeds to mix the contents with a mixing tool, like a paddle bit and drill motor or trowel. When the proper mixture is attained, and the worker confirms the airborne contaminants have been removed, the worker pulls the dust control device 10 off the container C and is able to install their mixture.

DETAILED DESCRIPTION OF THE PRESENT INVENTION

Figure 1:
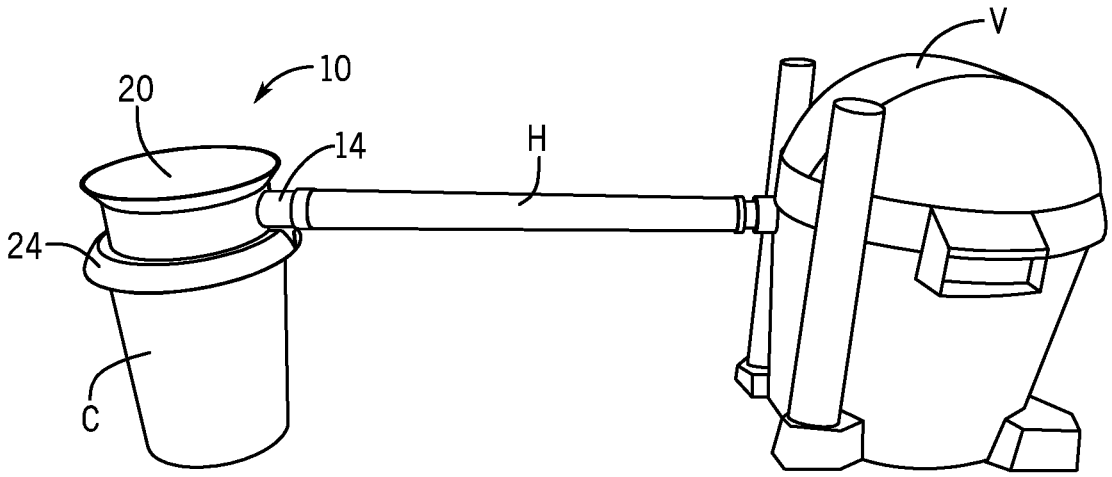
FIG. 1 shows the dust control device 10 sitting on a container C, such as a 3 or 5 gallon bucket, and a shop vacuum hose H attached to the outlet port 14 of the dust control device 10. It also shows a typical shop vacuum V.

Referring to FIG. 1, the dust control device 10 consists of a funnel shaped opening or inlet funnel 30 in the top of the dust control device, where the product is poured into. As the product enters this opening, the narrowing of the opening causes both the material and the air to increase in speed. The interior develops a low pressure zone by attachment of a shop vacuum, which is attached at the outlet port 14 of the dust control device 10 via the vacuum cleaner hose H. The dust control device 10 is placed on the mixing container C, usually a 3, 5 or 7 gallon bucket. The bucket interface groove 34 makes contact with the container C and the static pressure of the dust control device 10 resting on the container C is sufficient to seal them when the vacuum is applied. The worker can pour the material, add mixtures, and water or other required liquid into the inlet funnel 30. They next will typically use a paddle bit and drill motor to mix the materials in the low pressure zone of the interior of the container C through the inlet funnel 30. Once the desired consistency is achieved, the dust control device 10 can be lifted off of the container C and the material can be safely used.

Figure 2:
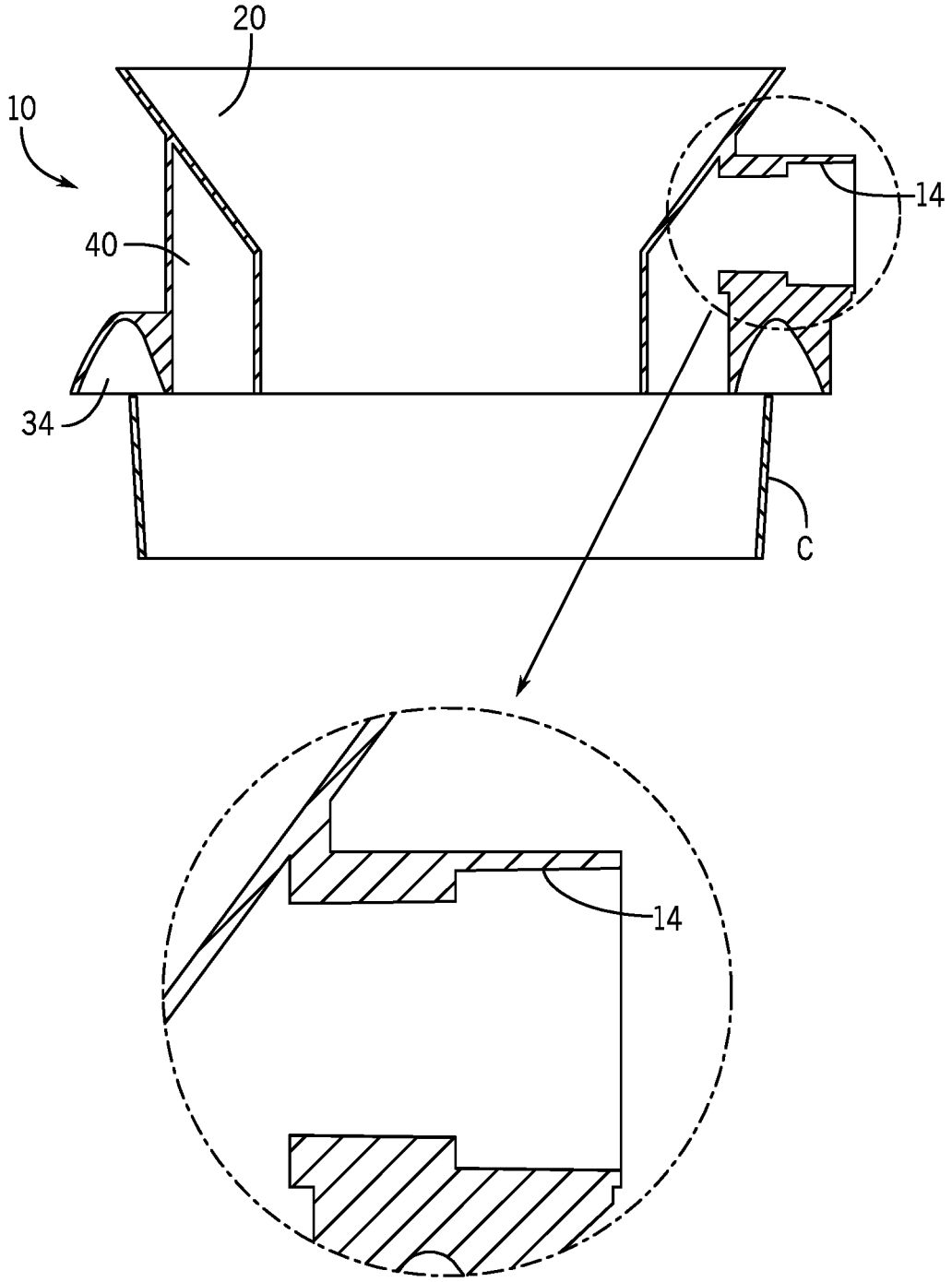
FIG. 2 shows a cross sectional view from the side of the dust control device 10 having an inlet funnel 20, the outlet port 14 with the 2 stage 1¾" and 2¼" connection point for the vacuum hose H. The base 24 of the dust control device 10 is designed to rest on top of a bucket or container C.

FIG. 2 shows a cross sectional view from the side of the dust control device 10. The inlet funnel 30 where material and the mixing tool will be introduced into the container C. The outlet channel 40 leads to the outlet port 14 with the two stage connection point to accommodate either 1¾" or 2¼" vacuum hoses. The interface groove 34 of the dust control device 10 is designed to rest on top of a container C.

Figure 3:
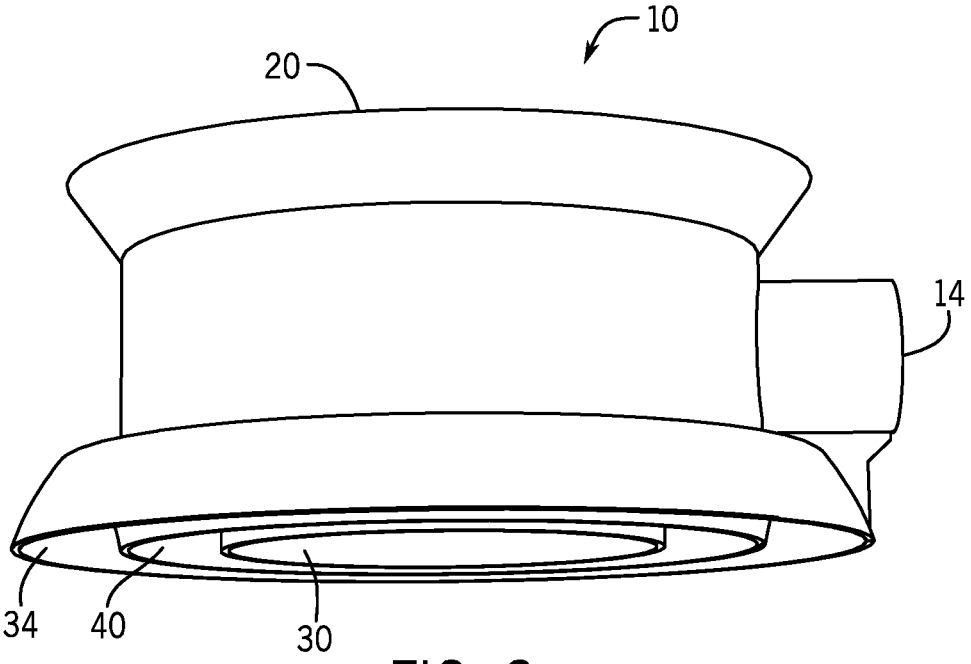
FIG. 3 shows a side perspective view of the dust control device 10 with the inlet funnel 20, the bottom of the inlet funnel 30, the bucket interface groove 34 and the outlet channel 40, which leads to the outlet port 14.

FIG. 3 shows a side perspective view of the dust control device 10 with the inlet funnel 20, the bottom of the inlet funnel 30, the bucket interface groove 34 and the outlet channel 40, which leads to the outlet port 14.

I claim:

1. A duct control device for withdrawing airborne particles from a container, the duct control device comprising:

a body defined by a cylindrical wall extending between a first open end and a second open end, wherein a hollow interior extends between the first and second open ends, the cylindrical wall having a continuous circumferential surface extending from the first open end and the second open end;

a funnel-shaped inlet portion extending from the first open end;

a base located at the second open end that is engageable with a container and that extends around at least a portion of the circumferential surface of the cylindrical wall;

an outlet port located between the first and second open ends of the body, the outlet port connectable to a vacuum source; and a channel extending around the entire circumferential surface of the cylindrical wall that is in fluid communication with the outlet port, wherein the channel has a bottom opening extending around the entire circumferential surface of the cylindrical wall and wherein the base surrounds the channel.

2. The dust control device of claim 1, wherein the base extends around the entire circumferential surface of the cylindrical wall.

3. The dust control device of claim 1, wherein the base includes an interface groove configured to mate with a top edge of a container.

4. The dust control device of claim 1, wherein the channel is defined by the circumferential surface of the cylindrical wall, an interior surface of the base, and an exterior surface of the funnel-shaped inlet portion.

5. A dust control system, comprising:

a container having an interior for receiving a dust-containing material;

a vacuum source; and a dust control device, comprising:

a body defined by a cylindrical wall extending between a first open end and a second open end, wherein a hollow interior extends between the first and second open ends, the cylindrical wall having a continuous circumferential surface extending from the first open end and the second open end;

a funnel-shaped inlet portion extending from the first open end;

a base located at the second open end that is engageable with the container and that extends around at least a portion of the circumferential surface of the cylindrical wall;

an outlet port located between the first and second open ends of the body, the outlet port connectable to a vacuum source; and a channel extending around the entire circumferential surface of the cylindrical wall that is in fluid communication with the outlet port and the interior of the container for withdrawing airborne particles when the outlet port is connected to the vacuum source, the channel having a bottom opening that extends towards the interior of the container and that extends around the entire circumferential surface of the cylindrical wall, wherein the base surrounds the channel.

6. The dust control system of claim 5, wherein the base extends around the entire circumferential surface of the cylindrical body.

7. The dust control system of claim 5, wherein the base includes an interface groove configured to mate with a top edge of the container.

8. The dust control system of claim 7, wherein the interface groove seals against the container when the outlet port is connected to the vacuum source.

9. The dust control system of claim 5, wherein the base seals against the container when the outlet port is connected to the vacuum source.

10. The dust control device of claim 5, wherein the channel is defined by the circumferential surface of the cylindrical wall, an interior surface of the base, and an exterior surface of the funnel-shaped inlet portion.

11. A method of controlling airborne particles from a dust-containing material, comprising:

disposing a dust control device of claim 1 on an open end of a container;

connecting a vacuum source to the outlet port of the dust control device to define a first pressure inside the container;

defining a second pressure lower than the first pressure inside the channel;

depositing a dust-containing material into the container;

releasing airborne particles within the container; and withdrawing the airborne particles through the outlet port.

12. The method of claim 11, further comprising depositing the dust-containing material into the container through the funnel-shaped inlet portion.

13. The method of claim 11, further comprising sealing the dust control device against the container.

* * * * *